US012721444B2

(12) United States Patent
Slongo et al.

(10) Patent No.: US 12,721,444 B2
(45) Date of Patent: Sep. 1, 2026

(54) REMOVAL MECHANISM

(71) Applicant: L&P Property Management Company, South Gate, CA (US)

(72) Inventors: Alessandro Slongo, Mogliano Veneto (IT); Alberto Busato, Paese (IT)

(73) Assignee: L&P Property Management Company, Carthage, MO (US)

( * ) Notice: Subject to any disclaimer, the term of this patent is extended or adjusted under 35 U.S.C. 154(b) by 113 days.

(21) Appl. No.: 18/863,948

(22) PCT Filed: Apr. 25, 2023

(86) PCT No.: PCT/EP2023/060758
§ 371 (c)(1),
(2) Date: Nov. 7, 2024

(87) PCT Pub. No.: WO2023/217523
PCT Pub. Date: Nov. 16, 2023

(65) Prior Publication Data

US 2025/0302201 A1 Oct. 2, 2025

(30) Foreign Application Priority Data

May 9, 2022 (EP) ..... 22172324

(51) Int. Cl.
*A47C 7/56* (2006.01)
*A47C 7/00* (2006.01)

(52) U.S. Cl.
CPC ..... *A47C 7/566* (2013.01); *A47C 7/004* (2013.01)

(58) Field of Classification Search
CPC ..... A47C 7/566; A47C 7/004
(Continued)

(56) References Cited

U.S. PATENT DOCUMENTS 3,620,494 A * 11/1971 De Gaston ..... A47C 3/24 74/89.45
3,995,824 A 12/1976 Bauer
(Continued)

FOREIGN PATENT DOCUMENTS

CA 2669053 A1 * 12/2009
CH 619604 A5 * 10/1980 ..... A47C 3/30
(Continued)

OTHER PUBLICATIONS

International Preliminary Report on Patentability received for PCT Patent Application No. PCT/EP2023/060758, mailed on Nov. 21, 2024, 7 pages.

*Primary Examiner* — Jose V Chen
(74) *Attorney, Agent, or Firm* — SHOOK, HARDY & BACON L.L.P.

(57) ABSTRACT

A chair component (200, 102) for a chair (100) is provided with a gas spring receiving hole (202) into which an end of a gas spring (104) of the chair (100) is insertable, and a removal mechanism (220) for removing the gas spring (104) from the chair component (200, 102). The removal mechanism (220) comprises a threaded bolt (222) arranged in a threaded hole (204) in the chair component (200, 102). The threaded hole (204) is arranged adjacent to the gas spring receiving hole (202). A longitudinal axis of the threaded hole (204) is essentially parallel to a longitudinal axis of the gas spring receiving hole (202). A screw drive (226) is provided at a first end of the threaded bolt (222) for turning the threaded bolt (222) in the threaded hole (204). An overlap element (228) is provided at a second end of the threaded bolt (222). The overlap element (228) extends in a radial direction beyond an outer circumference of the thread of the threaded bolt (222) to such an extent that the overlap
(Continued)

element (228) at least partially overlaps the gas spring receiving hole (202).

11 Claims, 9 Drawing Sheets

(58) Field of Classification Search
USPC ..... 297/300.3, 302.2
See application file for complete search history.

(56) References Cited

U.S. PATENT DOCUMENTS

| | | | | | |
|---|---|---|---|---|---|
| 4,283,033 | A * | 8/1981 | Bauer | A47C 7/004 | 248/188 |
| 2006/0131942 | A1* | 6/2006 | King | A47C 3/30 | 297/344.12 |
| 2006/0175518 | A1* | 8/2006 | Hu | A47C 9/007 | 248/157 |
| 2016/0227931 | A1* | 8/2016 | Ledat | A47C 3/30 | |
| 2016/0235205 | A1* | 8/2016 | Ballendat | A47C 7/004 | |
| 2018/0146789 | A1* | 5/2018 | Patton | A47C 3/18 | |
| 2018/0242743 | A1* | 8/2018 | Mezzera | A47C 1/03216 | |
| 2020/0093270 | A1* | 3/2020 | Lukas | A47C 31/008 | |
| 2024/0081533 | A1* | 3/2024 | DuFresne | A47C 1/03283 | |

FOREIGN PATENT DOCUMENTS

| | | | | |
|---|---|---|---|---|
| DE | 2428776 | A1 | 1/1976 | |
| DE | 2747777 | A1 | 4/1979 | |
| DE | 202009005418 | U1 * | 8/2010 | A47C 3/24 |
| DE | 102011109374 | A1 * | 2/2013 | A47C 3/026 |

* cited by examiner

REMOVAL MECHANISM

FIELD OF THE INVENTION

The present invention relates to a mechanism for removing a gas spring from a chair. In particular, the present invention relates to a chair component, for example a base support or a pedestal of a chair, comprising a removal mechanism for removing a gas spring from the chair component. The present invention furthermore relates to a chair, for example an office chair, comprising the chair component with the removal mechanism.

BACKGROUND OF THE INVENTION

Common adjustments for chairs, in particular office-type chairs, may include a height adjustment of the chair seat, an adjustment of an inclination of the chair seat and the chair back as well as an arrangement of the chair seat with respect to the chair back. These chair adjustments allow users to change their sitting position in the chair as desired such that fatigue may be minimized during long sitting periods.

For adjusting the height of the chair seat, a gas spring may be provided between a pedestal and a base support. The pedestal may comprise a plurality of feet extending in radial directions, which are often wheeled with casters at distal ends. For example, the pedestal may be a 5-star base. The base support may support the chair seat directly or via an intermediate seat support. The base support may further support the chair back and may comprise a mechanism for adjustment of inclination of the chair seat and the chair back. The gas spring, also called gas lift, commonly comprises a cylinder, a piston which is movable within the cylinder, and a piston rod extending from and coupled to the piston. The gas spring may be arranged in a vertical direction between the pedestal and the base support. For example, a lower end of the cylinder may be mounted at the pedestal and an upper end of the piston rod may be mounted at a lower side of the base support. Upon moving of the piston within the cylinder, a height of the base support with respect to the pedestal may be adjusted.

The upper end of the piston rod may have a conical shape which may be inserted in a conical hole in the base support. Likewise, the lower end of the cylinder may have a conical shape which may be inserted in a conical hole in the pedestal. This tapered interference fit is very reliable and easy to make, but is very difficult to separate once installed. One option is to hammer out the gas spring, which can cause irreversible damage. Another option is to use special tools. Neither option is suitable for an end user without technical training and experience and without the risk of damaging the product or injuring themselves.

BRIEF SUMMARY OF THE INVENTION

It is an object of the present invention to provide a chair which addresses some of the above problems. In particular, it is an object to provide a mechanism for easily removing a gas spring from a height adjustable chair. Removing the gas spring should be possible for a user with minimal effort, without technical experience and without risk of damaging the product or getting injured.

This object is achieved by a chair component and a chair comprising the chair component as defined in the independent claims. The dependent claims define embodiments.

A chair component for a chair is provided. The chair may be a height adjustable chair, for example an office chair, a home chair, or an industrial chair. The chair component is provided with a gas spring receiving hole into which an end of a gas spring of the chair is insertable. For example, the chair component may be a base support of the chair configured to support a chair seat. In other examples, the chair component may be a pedestal of the chair. The chair component comprises a removal mechanism for removing the gas spring from the chair component. The removal mechanism comprises a threaded bolt arranged in a threaded hole in the chair component. The threaded hole is arranged adjacent to the gas spring receiving hole. A longitudinal axis of the threaded hole is essentially parallel to a longitudinal axis of the gas spring receiving hole. A screw drive is provided at a first end of the threaded bolt for turning the threaded bolt in the threaded hole. An overlap element is provided at a second end of the threaded bolt opposing the first end. The overlap element extends in a radial direction beyond an outer circumference of the thread of the threaded bolt to such an extent that the overlap element at least partially overlaps the gas spring receiving hole.

It is to be understood that the terms "up", "down", "upwards", "downwards", "upper side" and "lower side", as used herein, each have a particular meaning that is defined in relation to a flat support surface beneath the chair, for example in relation to a floor on which the chair rests and in relation to an occupant sitting in a usual seated position on the chair. The terms "down", "downwards" and "lower side" refer to the side facing to the flat support surface beneath the chair, and the terms "up", "upwards" and "upper side" refer to the side facing away from the flat support surface beneath the chair.

In various examples, the threaded hole and the gas spring receiving hole each extend from a first surface of the chair component to an opposing second surface of the chair component. For example, when the chair component is a base support, the first surface may be a lower side of the base support and the second surface may be an upper side of the base support. When the chair component is a pedestal, the first surface may be an upper side of the pedestal and the second surface may be a lower side of the pedestal. The threaded bolt is screwed into the threaded hole from the second surface. The gas spring receiving hole has a conical shape with a first diameter at the first surface and a second diameter at the second surface. The second diameter is smaller than the first diameter. In other words, the gas spring may be inserted in the gas spring receiving hole from the first side. For example, a piston rod of the gas spring may be inserted from the lower side into the gas spring receiving hole of the base support. Likewise a cylinder of the gas spring may be inserted from the upper side into the gas spring receiving hole of the pedestal.

The threaded bolt may be positioned by turning the threaded bolt within the threaded hole between a mounting position and a removal position. In the mounting position, the gas spring can be mounted at the chair component. In the removal position, the gas spring is removed from the chair component by the removal mechanism. This may be achieved by adjusting a distance between the overlap element and the second surface: A distance between the overlap element and the second surface in the mounting position is larger than a distance between the overlap element and the second surface in the removal position.

For example, the chair component may be configured such that, when the gas spring is mounted to the chair component, an end of the gas spring protrudes from the second surface of the chair component. The overlap element is arranged and configured such that, when the gas spring is mounted to the chair component and the threaded bolt is moved from the mounting position to the removal position, the overlap element urges the end of the gas spring to reduce an amount by which the end of the gas spring protrudes beyond the second surface of the chair component.

For example, the upper end of the piston rod may have conical shape configured such that when the piston rod is inserted from the lower side (first surface) in the gas spring receiving hole of the base support, the upper end of the piston rod at least partially extends beyond the upper side (second surface) of the base support. As long as the threaded bolt is in the mounting position, the gap between the overlap element and the upper surface of the base support is large enough to allow the piston rod to protrude beyond the upper surface of the base support without being obstructed by the overlap element. Due to the force of gravity in the downward direction exerted by a user sitting on the chair, the conical shape of the gas spring receiving hole and the conical shape of the piston rod engage with each other. When the threaded bolt is moved to the removal position, the distance between the overlap element and the upper side of the base support decreases, and the overlap element contacts the upper end of the piston rod and urges the upper end of the piston rod in the downward direction. This separates the piston rod from the base support.

By turning the threaded bolt, a relatively small torque can be used to exert a very large force on the gas spring (e.g. upper side of the piston rod) via the overlap element, which enables to separate the connection between the conical shape of the gas spring receiving hole and the conical shape of the gas spring. The turning of the threaded bolt can be performed by a user without specific knowledge, without great effort and without risk of injury.

According to various examples, the overlap element has a circular outer shape coaxial with a longitudinal axis of the threaded bolt. Thus, while turning the threaded bolt, the overlap element continuously overlaps a same area of the gas spring receiving hole. For example, the overlap element may comprise a screw head and washer. The washer defines the area which is overlapped by the overlap element. A traditional screw may be used as the threaded bolt. The washer may reduce friction. For example, the screw head may rotate with respect to the washer while the washer urges the gas spring without rotating.

In further examples, the overlap element may comprise a screw head and a washer with a rectangular outer shape. For example, the washer may be a flat rectangular plate with a bore or hole. The threaded bolt may extend through the bore or hole. The rectangular outer shaped may prevent rotation of the washer and may optimize utilization of the available space. The washer may have any other outer shape as appropriate, e.g. a square shape, a triangular shape or a combination of a rectangular shape and a semicircular shape at one side of the rectangular shape.

In further examples, an outer diameter of the screw drive at the first end is smaller than an outer diameter of the thread of the threaded bolt. For example, the screw drive at the first end may comprise a hex key, which is also known as Allen key, or a hexalobular internal, which is also known as star drive or Torx drive. Using a screw drive with a diameter which is smaller than an outer diameter of the threat of the threaded bolt enables insertion of the threaded bolt from the second side, i.e. the threaded bolt enters the threaded hole with the first end. A hex wrench or Torx wrench may be inserted at the first surface of the chair component into the screw drive for turning the threaded bolt. Even when the threaded bolt is turned in the threaded hole to such an extent that it does not protrude at the first surface, it still can be actuated using the hex-wrench or Torx wrench due to the smaller diameter.

A chair comprises a pedestal, a gas spring, a base support, and a chair seat. At least one of the pedestal and the base support comprises the chair component as described above. The chair seat may be arranged on an upper side of the base support. The gas spring may be provided between a lower side of the base support and an upper side of the pedestal. For removing the gas spring from the base support, the base support may be provided with the above described removal mechanism. Likewise, for removing the gas spring from the pedestal, the pedestal may be provided with the above described removal mechanism.

BRIEF DESCRIPTION OF THE DRAWINGS

Embodiments of the invention will be described with reference to the accompanying drawings.

DETAILED DESCRIPTION OF EMBODIMENTS

Exemplary embodiments of the invention will be described with reference to the drawings. While some embodiments will be described in the context of specific fields of application, such as in the context of an office type chair, home chair or industrial chair, the embodiments are not limited to this field of application. The features of the various embodiments may be combined with each other unless specifically noted otherwise. Same reference signs in the various drawings refer to similar or identical components.

Figure 1:
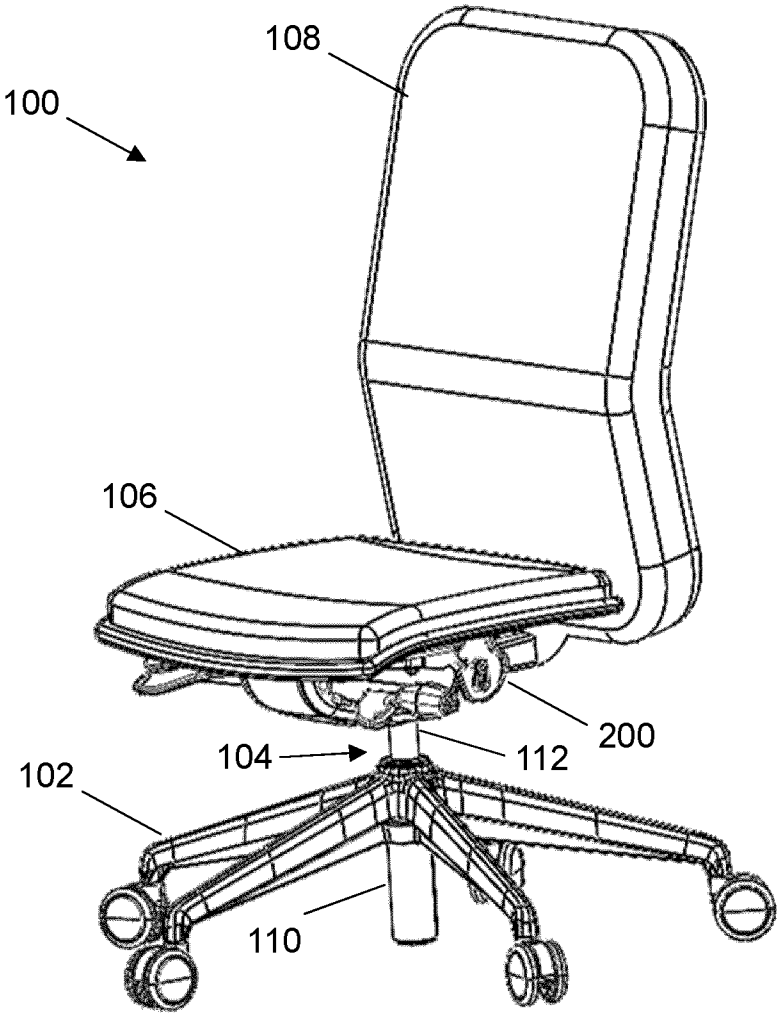
FIG. 1 is a schematic isometric view of a chair comprising a chair component according to an embodiment.

FIG. 1 shows a chair 100 which includes a pedestal 102, a gas spring 104, a base support 200, a chair seat 106 and a chair back 108. As an example, the chair 100 is illustrated to be a height adjustable chair. The base support 200 may comprise a motion mechanism. The base support 200 may connect the chair seat 106, the chair back 108 and the gas spring 104. The motion mechanism may effect a coordinated motion of the chair back 108 and the chair seat 106. The pedestal 102 includes a number of support feet extending radially from a center of the pedestal 102 and a corresponding number of casters supported on the outer ends of the support feet. The gas spring 104, also known as gas cylinder or lifting mechanism, may be mounted at the center of the pedestal 102 to enable the height of the chair seat 106 to be adjusted by an occupant.

The gas spring 104 comprises a cylinder 110, a piston within the cylinder 110, and a piston rod 112. The gas spring 104 may comprise further components, for example a piston rod guide bushing, a piston rod seal, one or more valves and a coil spring. The piston is movable in the up and down directions. A lower end of the piston rod 112 is coupled to the piston within the cylinder 110 and an upper end of the piston rod 112 is coupled to the base support 200. For coupling the piston rod 112 to the base support 200, the base support may provide a gas spring receiving hole into which the upper end of the piston rod 112 is inserted. The upper end of the piston rod 112 may have a conical shape that tapers further upward. The gas spring receiving hole may have a matching conical shape that tapers further upward also.

The lower end of the cylinder 110 is coupled to the pedestal 102. The pedestal 102 may have a central hole into which the lower end of the cylinder 110 may be inserted. The lower end of the cylinder 110 may have a conical shape that tapers further downward. The central hole may have a matching conical shape that tapers further downward also.

In this way, a strong and reliable connection is made between the upper end of the piston rod 112 and the base support 200, and between the lower end of the cylinder 110 and pedestal 102. The connection may strengthen when a user sits on the chair and presses the conical surfaces against each other. However, separating the gas spring from the base support 200 or pedestal 102 may be difficult and may require large forces.

Figure 2:
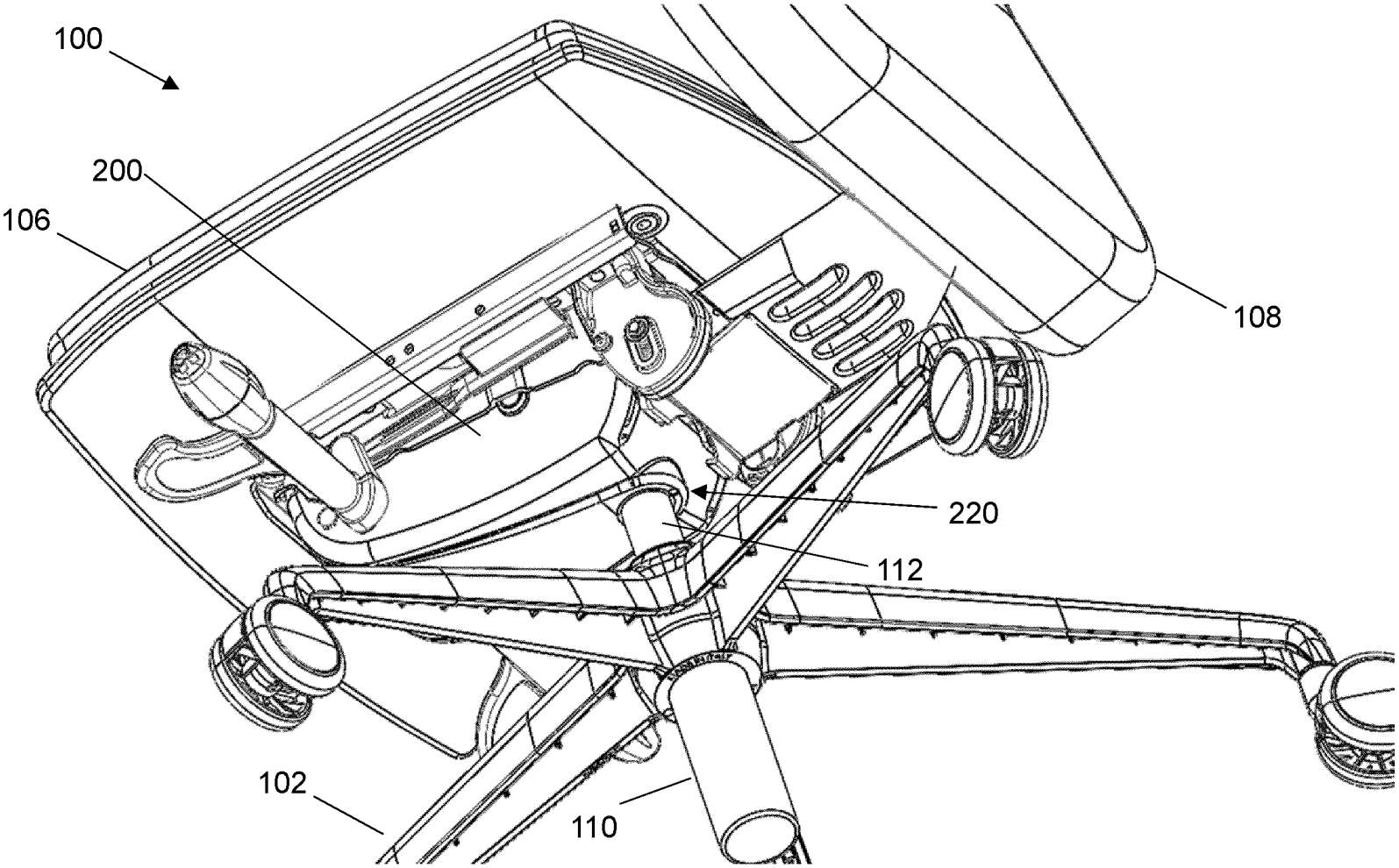
FIG. 2 is an isometric view from below of the chair of FIG. 1.

Separating the gas spring from the base support 200 or the pedestal 102 may be necessary for replacement of the gas spring or for stowing the chair in a space-saving manner. In order to achieve this without requiring large forces to be applied by an operator, a removal mechanism can be provided, which will be described below using the base support 200 as an example. FIG. 2 is an isometric view from below of the chair of FIG. 1 and indicates a suitable position of the removal mechanism 220 at the base support 200. It is obvious for a person skilled in the art that is such a removal mechanism can be provided in the same way at the pedestal 102.

Figure 3:
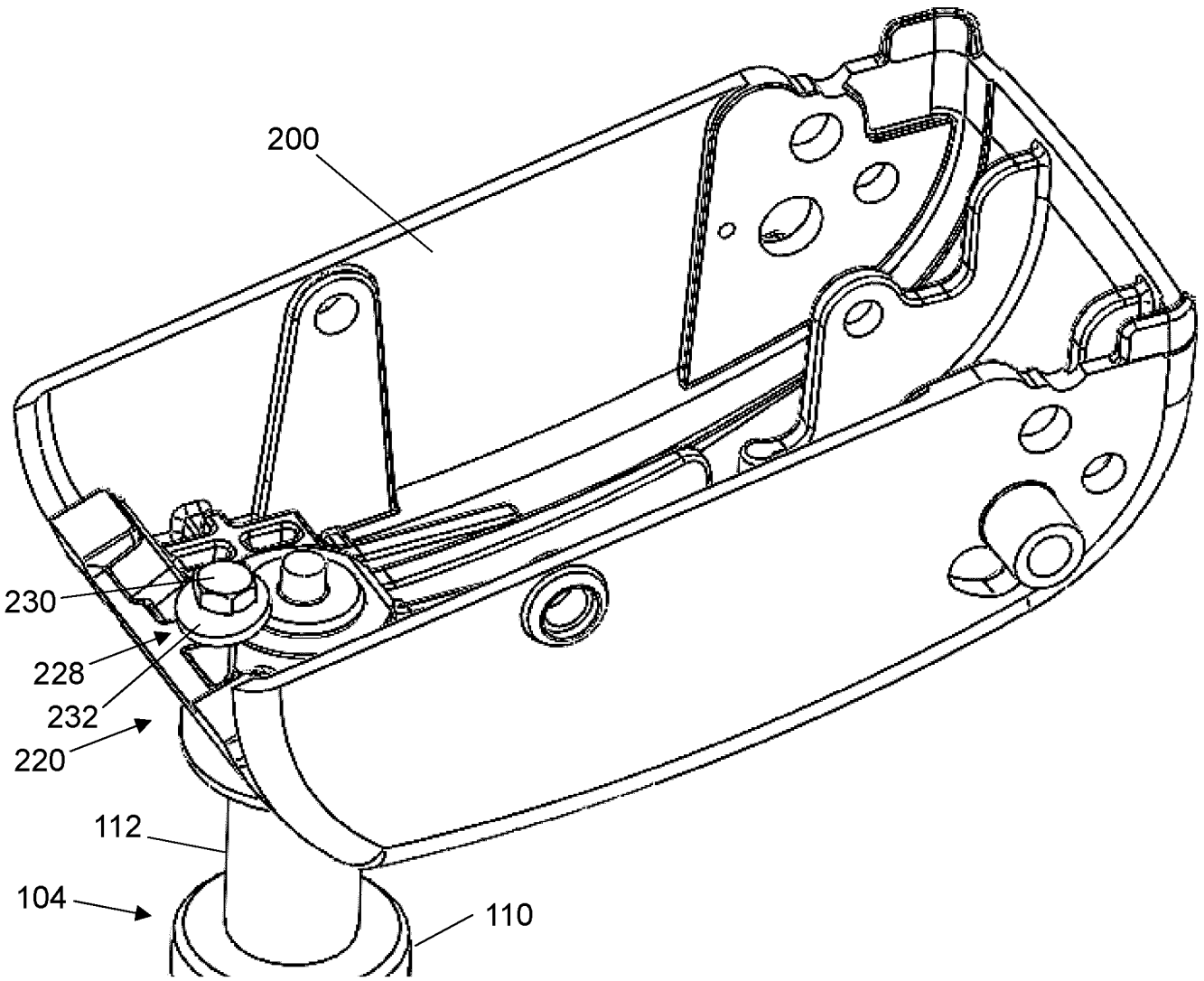
FIG. 3 is a schematic isometric view of a base support according to an embodiment with a removal mechanism in a mounting position.
Figure 4:
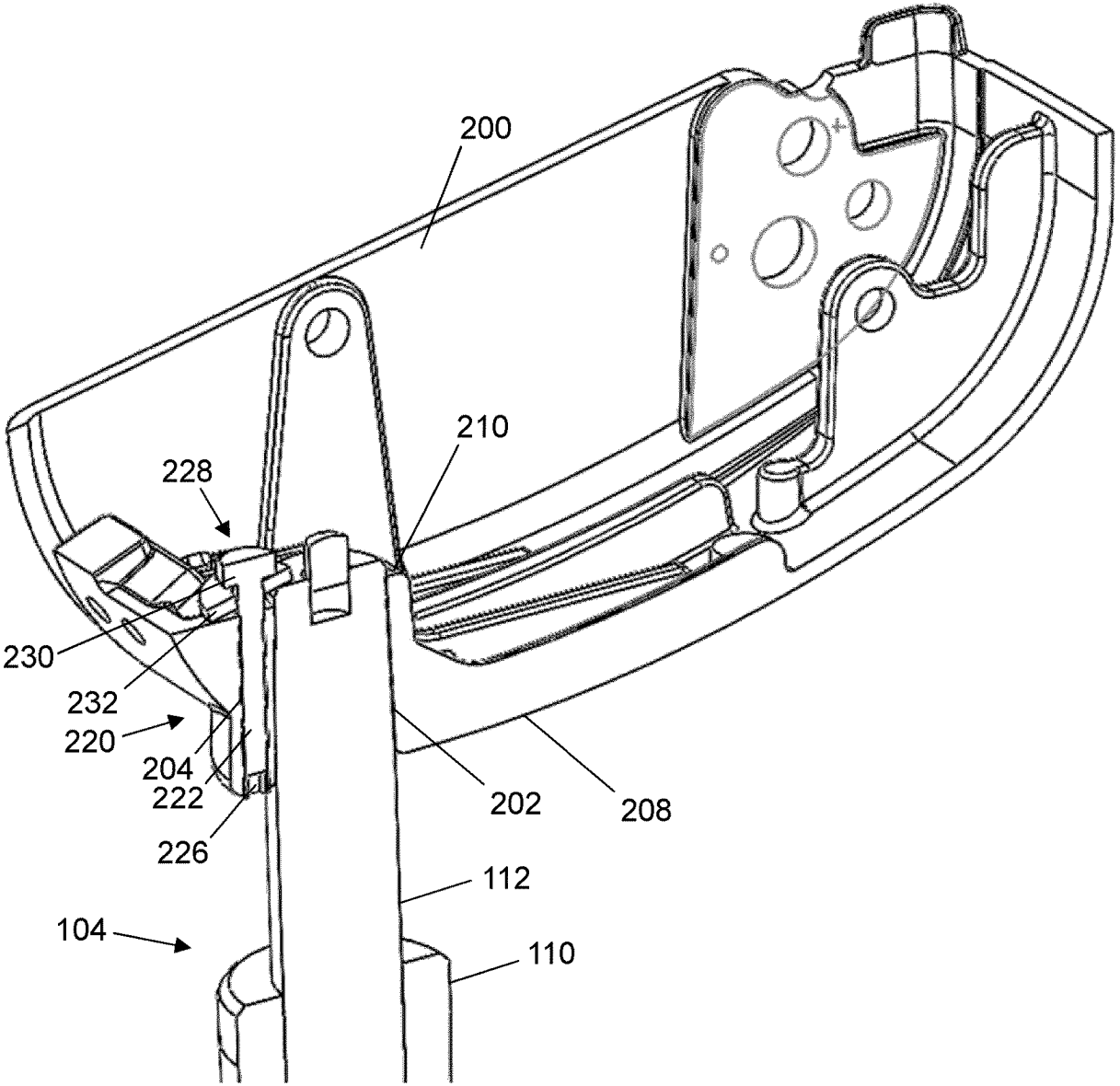
FIG. 4 is a schematic isometric cross-sectional view of the base support of FIG. 3.

FIG. 3 is a schematic isometric view of the base support 200 in connection with the gas spring 104. The base support 200 includes a removal mechanism 220. In FIG. 3, the pedestal 102, the chair seat 106 and a chair back 108 are not shown for clarity reasons. FIG. 4 show a schematic isometric cross-sectional view of the base support 200 of FIG. 3, and FIG. 5 shows a schematic cross-sectional side view of the base support 200 of FIG. 3.

Figure 5:
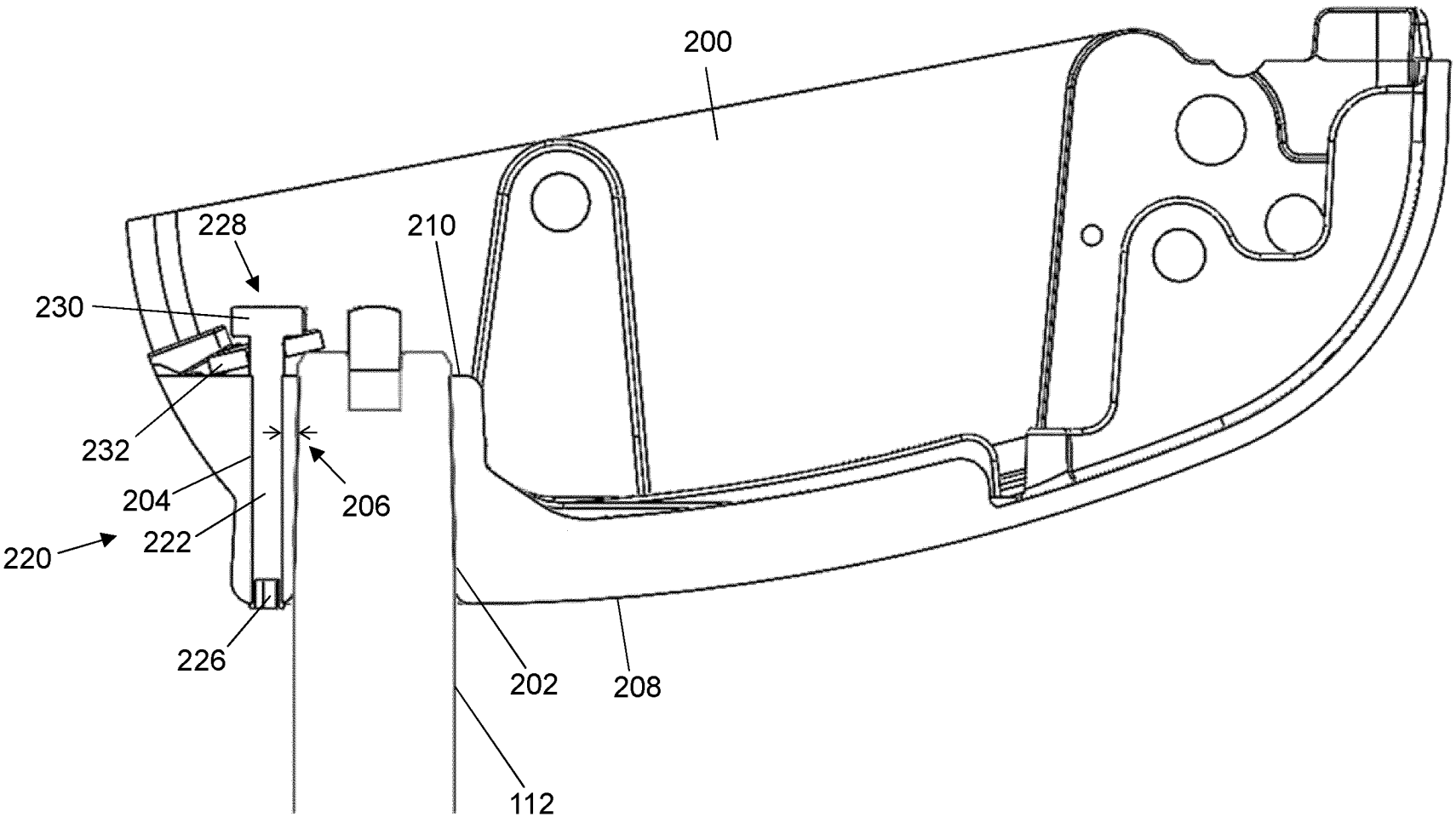
FIG. 5 is a schematic cross-sectional side view of the base support of FIG. 3.

As illustrated in FIG. 3 to FIG. 5, the conical upper end of the piston rod 112 is inserted in a matching conical gas spring receiving hole 202 of the base support 200. The conical shapes of the upper end of the piston rod 112 and the matching hole 202 have a decreasing diameter in the upward direction. The upper end of the piston rod 112 protrudes slightly beyond the upper edge of the hole 202, for example by a few millimeters, for example 3 to 5 mm. In other words, when the piston rod 112 is inserted at a first lower surface 208 of the base support 200 in the upwards direction, the upwards movement of the piston rod 112 is limited by the engagement of the conical shape of the piston rod 112 with the matching conical shape of the hole 202. In the engaged position, the upper end of the piston rod 112 protrudes slightly beyond a second upper surface 210 of the base support 200 in the upwards direction.

The removal mechanism 220 comprises a threaded bolt 222 which is arranged in a matching threaded hole 204 in the base support 200. The threaded hole 204 is arranged adjacent to the gas spring receiving hole 202. Preferably, a longitudinal axis of the threaded hole 204 and a longitudinal axis of the gas spring receiving hole 202 are parallel. A distance 206 between the threaded hole 204 and the gas spring receiving hole 202 may be small, for example a few millimeters, for example 3 to 5 mm. A diameter of the threaded hole 204 may be a few millimeters. For example, the threaded bolt 222 and the threaded hole 204 may have matching metric threads, such as in the range of M4 to M10, preferably M6. In other examples the threaded bolt 222 and the threaded hole 204 may have matching imperial threads.

At a first end at the lower side of the threaded bolt 222 a screw drive 226 is provided for turning the threaded bolt 222 in the threaded hole 204. The screw drive 226 may be a set of shaped cavities and protrusions on first end at the lower side of the threaded bolt 222 that allows torque to be applied to the threaded bolt 222. The screw drive 226 may comprise for example a hex key, also known as Allen key, or a hexalobular internal, also known as star drive or Torx. For example the screw drive 226 may comprise a hex key with a size in the range of 3 to 8, or a hexalobular internal with a size in the range of T10 to T40. In particular, the first end of the threaded bolt 222 is headless such that the first end of the threaded bolt 222 may be completely screwed in and through the threaded hole 204. In other words, the screw drive at the first end may be smaller than an outer diameter of the thread of the threaded bolt 222.

Figure 6:
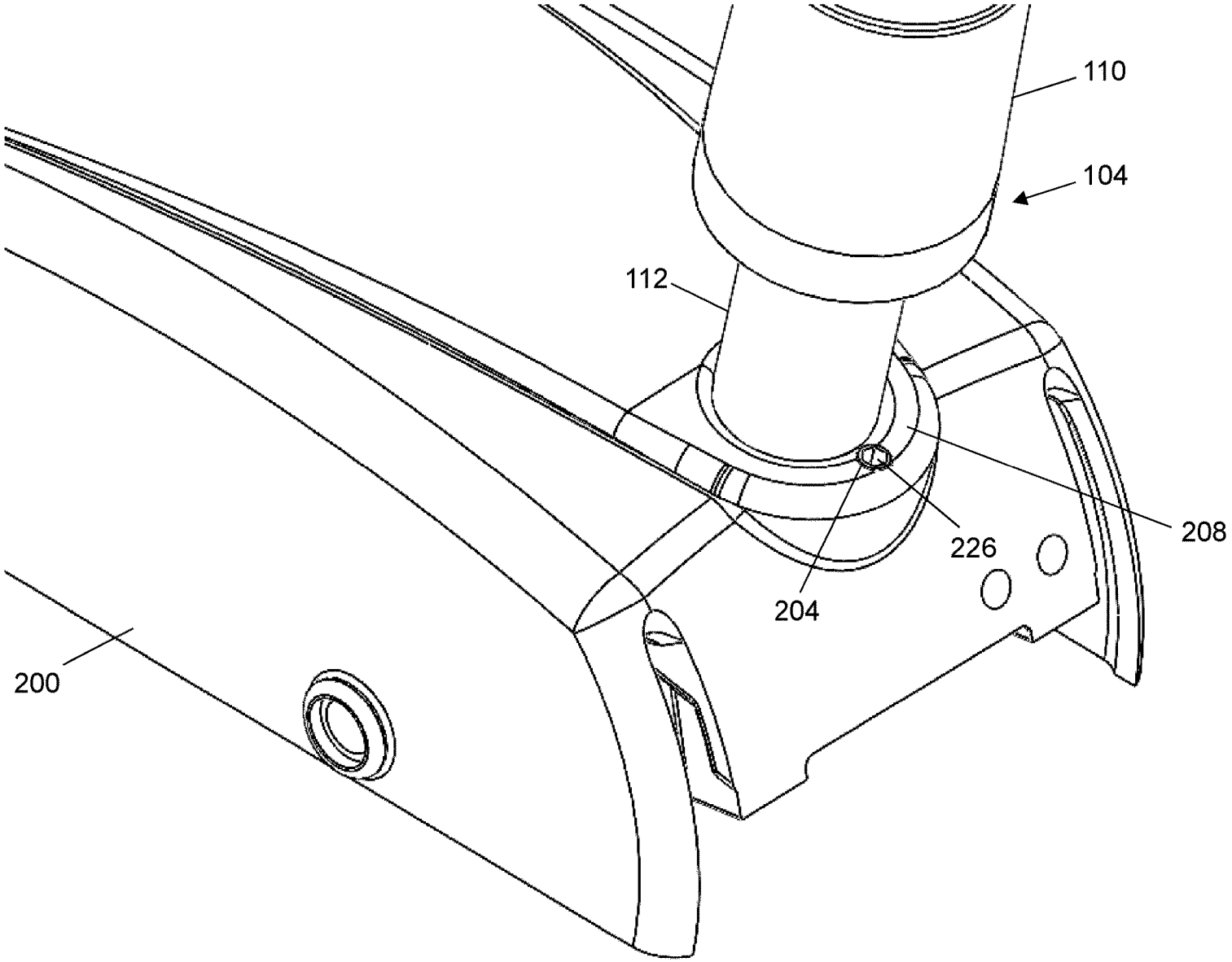
FIG. 6 is an isometric view from below of the base support of FIG. 3.

FIG. 6 shows the screw drive 226 within the threaded hole 204 in an isometric view from below the base support 200.

At a second end at the upper side of the threaded bolt 222 an overlap element 228 is provided. The overlap element 228 may comprise for example a screw head 230 in combination with a washer 232. The overlap element 228 may extend in a radial direction from a longitudinal axis of the threaded bolt 222 beyond an outer circumference of the threaded hole 204 to such an extent that the overlap element 228 at least partially overlaps the gas spring hole 202. As a result, the overlap element 228 also at least partially overlaps the upper and of the piston rod 212.

The overlap element 228 may have a circular outer shape. For example, the outer shape of the screw head 230 and/or the outer shape of the washer 232 may be circular. In other examples, the screw head 230 may have a non-circular out shape, e.g. a hexagonal shape as shown in FIG. 3, and the washer 232 may have a circular outer shape.

A position of the threaded bolt 222 in the up/down and direction is adjustable by turning the threaded bolt 222 within the threaded hole with 204.

In FIG. 3 to FIG. 5, the threaded bolt 222 is in a position in which the piston rod 112 can extend beyond the upper edge of the gas spring receiving hole 202, i.e. the upper end of the piston rod 112 can extend beyond the upper surface 210. In this position, the gas spring 104 can be mounted at the base support 200. Therefore, this position is called the "mounting position". In the mounting position, a distance between the lower side of the overlap element 228, for example the lower side of the washer 232, and the upper edge of the spring receiving hole 202 is at least the amount by which the upper end of the piston rod 112 protrudes beyond the upper edge of the gas spring receiving hole 202. The distance in the mounting position may be in the range of a few millimeters, for example 3 to 5 mm.

By turning the threaded bolt 222 in the threaded hole 204, the threaded bolt 222 can be moved in the downward direction. For example, the threaded bolt 222 can be turned in the threaded hole 204 by applying a corresponding Allen key or Torx wrench to the screw drive 226. The screw drive 226 may be accessible even in an assembled state of the chair 100, i.e. the screw drive 226 is accessible without removing the chair seat 106 from the base support 200.

The rotation of the threaded bolt 222 causes a downward movement of the threaded bolt 222 such that a large force can be generated by applying a small torque on the screw drive 226. The small torque can be easily applied by an operator using a corresponding simple and inexpensive tool, for example an Allen key or Torx tool. The resulting large force presses the piston rod 112 out of the gas spring receiving hole 202. No complex special tools are required to press out the piston rod 112. Hammering out the piston rod 112 can be avoided, preventing damage to the piston rod 112 and base support 200.

Figure 7:
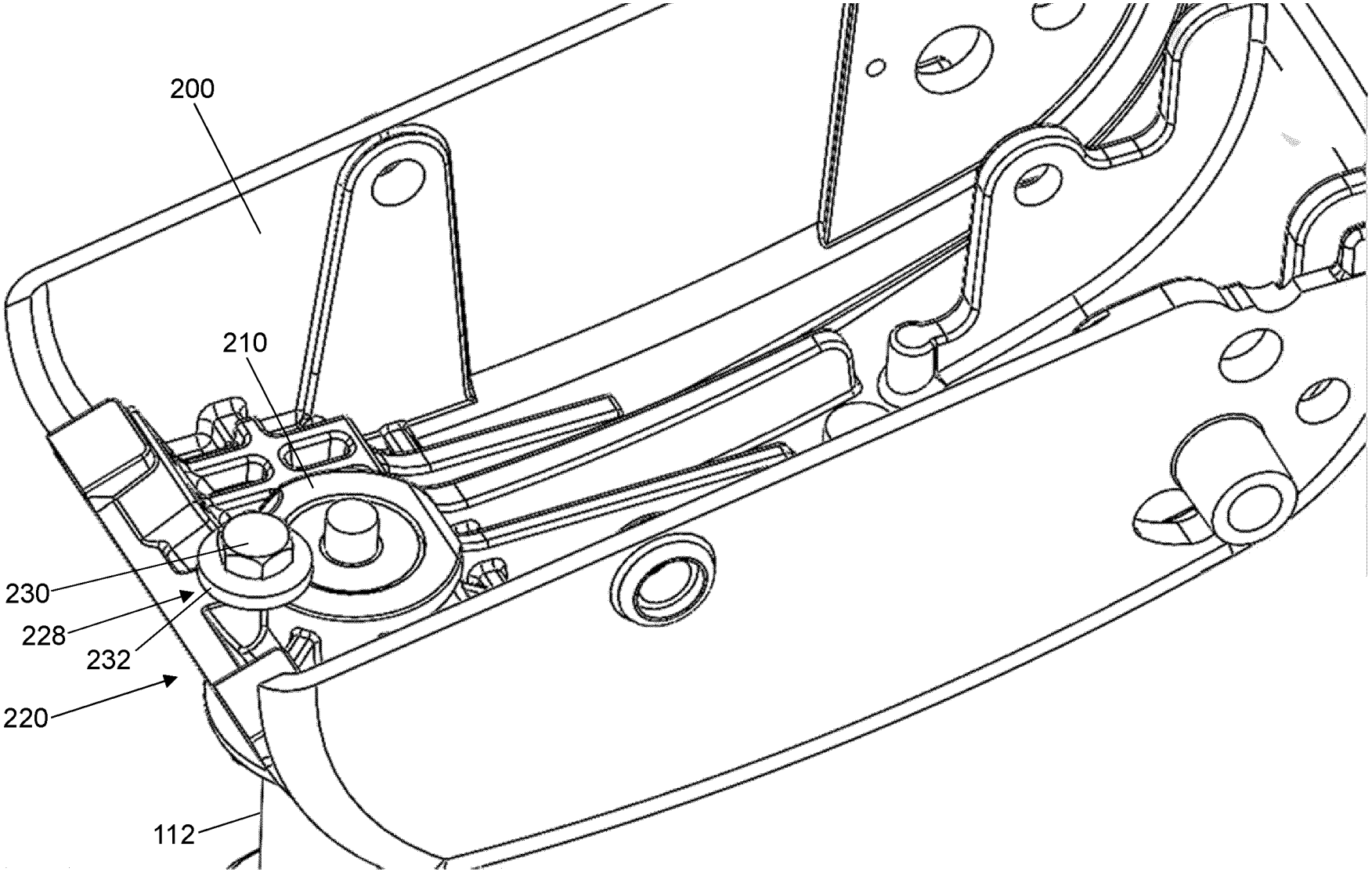
FIG. 7 is a schematic isometric view of a base support according to an embodiment with a removal mechanism in a removal position.
Figure 8:
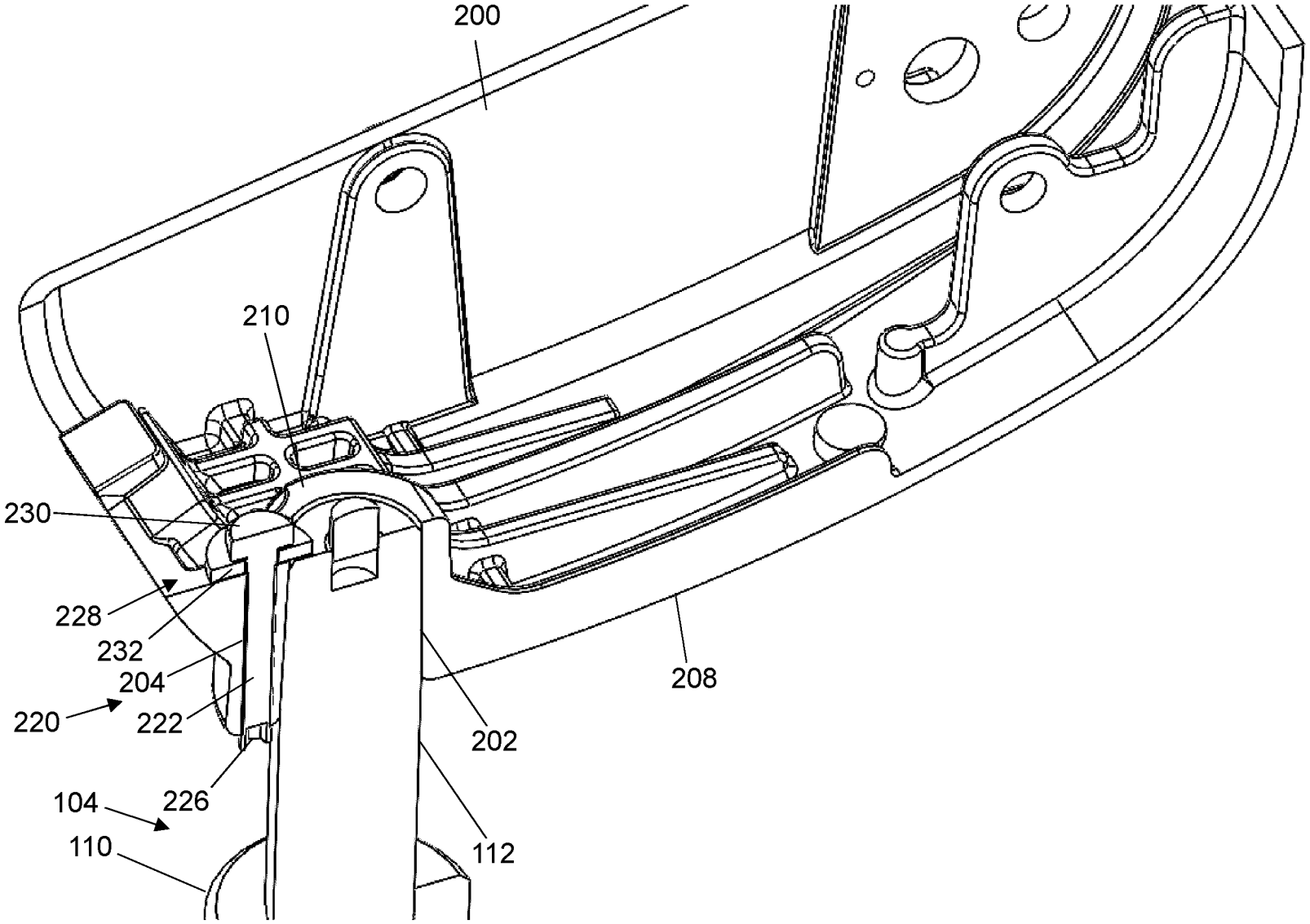
FIG. 8 is a schematic isometric cross-sectional view of the base support of FIG. 7.
Figure 9:
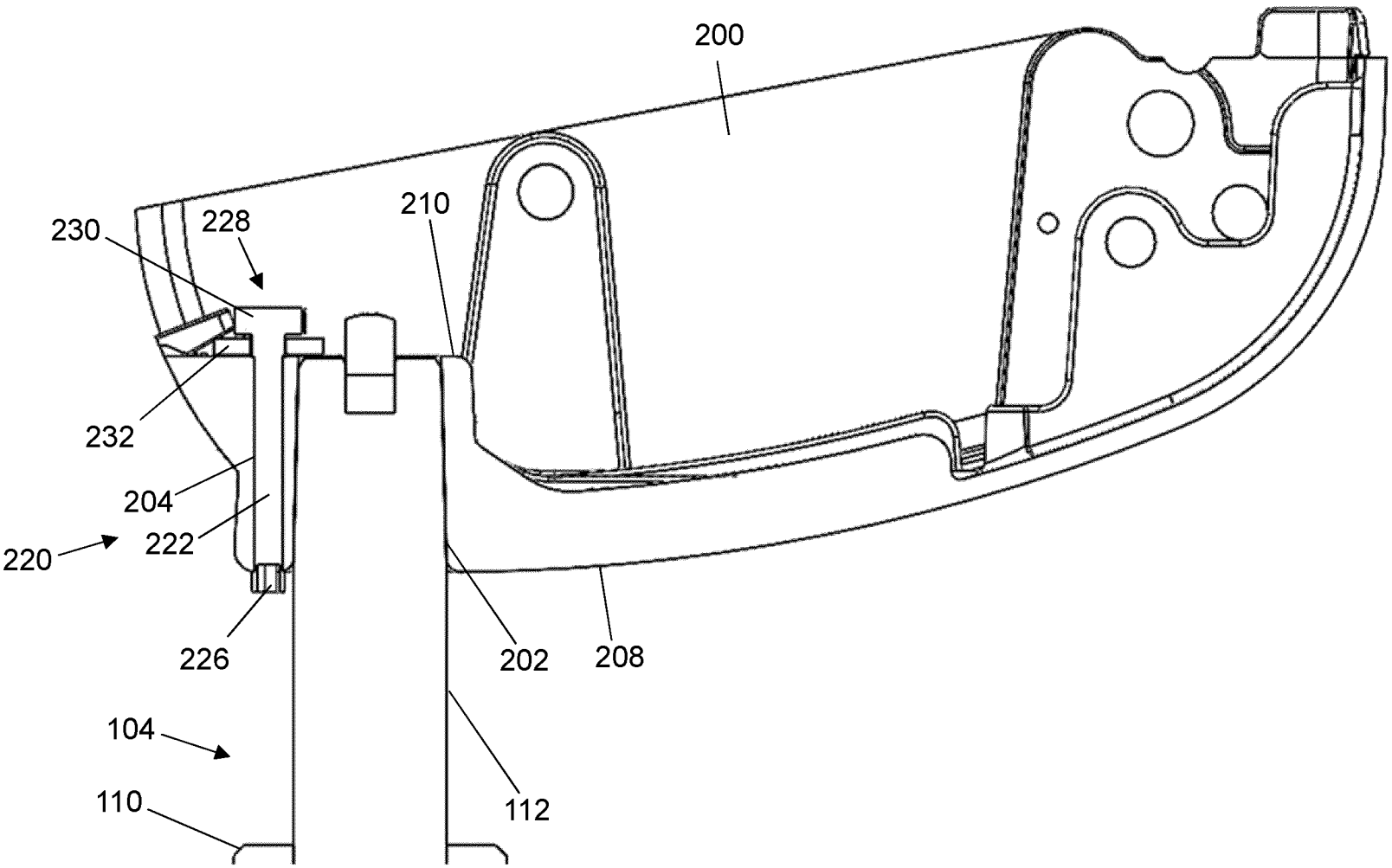
FIG. 9 is a schematic cross-sectional side view of the base support of FIG. 7.

FIG. 7 to FIG. 9 show the threaded bolt 222 in a position in which the piston rod 112 has been urged in the downward direction such that engagement between the conical shape of the upper end of the piston rod 112 and the conical shape of the gas spring receiving hole 202 is released. In this position, the gas spring 104 can be removed from the base support 200. Therefore, this position is called the "removal position". As can be seen in particular in FIG. 9, in the removal position, the distance between the lower side of the overlap element 228, in particular the lower side of the washer 232, and the upper edge of the spring receiving hole 202 has been reduced compared to the corresponding distance in the above described mounting position. The distance in the removal position may be close to zero, for example less than 3 mm, in particular less than 1 mm.

As discussed above, a similar removal mechanism may be provided at pedestal 102 for removing the cylinder 110 from a corresponding cylinder receiving hole in the pedestal 102. A threaded hole may be provided in the pedestal 102 parallel to and close by the cylinder receiving hole. The overlap element of a corresponding threaded bolt may be provided at the lower side whereas the drive screw of the threaded bolt is at an upper side of the pedestal 102 and accessible from the upper side.

While exemplary embodiments have been described in the context of office-type chairs, the removal mechanism 220 and the chair 100 according to embodiments of the invention are not limited to this particular application. Rather, embodiments of the invention may be employed in a wide variety of chairs comprising gas springs. For example, the removal mechanism 220 can be applied to any chair mechanism, for example to structures that fit a gas cylinder or gas spring.

The invention claimed is:

1. A chair component for a chair, wherein the chair component is provided with a gas spring receiving hole into which an end of a gas spring of the chair is insertable, and a removal mechanism for removing the gas spring from the chair component, wherein the removal mechanism comprises a threaded bolt arranged in a threaded hole in the chair component, wherein the threaded hole is arranged adjacent to the gas spring receiving hole, wherein a longitudinal axis of the threaded hole is essentially parallel to a longitudinal axis of the gas spring receiving hole, wherein a screw drive is provided at a first end of the threaded bolt for turning the threaded bolt in the threaded hole, and wherein an overlap element is provided at a second end of the threaded bolt, the overlap element extending in a radial direction beyond an outer circumference of the thread of the threaded bolt to such an extent that the overlap element at least partially overlaps the gas spring receiving hole.

2. The chair component of claim 1, wherein the overlap element has a circular outer shape coaxial with a longitudinal axis of the threaded bolt.

3. The chair component of claim 1, wherein the overlap element comprises a screw head and a washer.

4. The chair component of claim 1, wherein an outer diameter of the screw drive at the first end of the threaded bolt is smaller than an outer diameter of the thread of the threaded bolt.

5. The chair component of claim 1, wherein the screw drive at the first end of the threaded bolt comprises at least one of a hex key and a hexalobular internal.

6. The chair component of claim 1, wherein the threaded hole and the gas spring receiving hole each extend from a first surface of the chair component to an opposing second surface of the chair component, wherein the threaded bolt is screwed into the threaded hole from the second surface, wherein the gas spring receiving hole has a conical shape with a first diameter at the first surface and a second diameter smaller than the first diameter at the second surface.

7. The chair component of claim 6, wherein the threaded bolt is adjustable by turning the threaded bolt within the threaded hole between a mounting position in which the gas spring can be mounted at the chair component and a removal position in which the gas spring is removed from the chair component, wherein a distance between the overlap element and the second surface in the mounting position is larger than a distance between the overlap element and the second surface in the removal position.

8. The chair component of claim 7, wherein the chair component is configured such that, when the gas spring is mounted to the chair component, an end of the gas spring protrudes from the second surface of the chair component, wherein the overlap element is configured such that, when the gas spring is mounted to the chair component, the overlap element urges the end of the gas spring to reduce an amount by which the end of the gas spring protrudes beyond the second surface of the chair component as the overlap element transitions from the mounting position to the removal position.

9. The chair component of claim 1, wherein the chair component comprises a base support of the chair configured to support a chair seat.

10. The chair component of claim 1, wherein the chair component comprises a pedestal of the chair.

11. A chair, comprising a pedestal, a gas spring, a base support, and a chair seat, wherein at least one of the pedestal and the base support comprises a chair component provided with a gas spring receiving hole into which an end of a gas spring of the chair is insertable, and a removal mechanism for removing the gas spring from the chair component, wherein the removal mechanism comprises a threaded bolt arranged in a threaded hole in the chair component, wherein the threaded hole is arranged adjacent to the gas spring receiving hole, wherein a longitudinal axis of the threaded hole is essentially parallel to a longitudinal axis of the gas spring receiving hole, wherein a screw drive is provided at a first end of the threaded bolt for turning the threaded bolt in the threaded hole, and wherein an overlap element is provided at a second end of the threaded bolt, the overlap element extending in a radial direction beyond an outer circumference of the thread of the threaded bolt to such an extent that the overlap element at least partially overlaps the gas spring receiving hole.

* * * * *